United States Patent [19]

Moss

[11] 4,155,313

[45] May 22, 1979

[54] UTILIZATION OF SOLID MATERIAL CONTAINING COMBUSTIBLE MATTER

[75] Inventor: Gerald Moss, Wantage, England

[73] Assignee: The United States of America as represented by the Administrator of the U.S. Environmental Protection Agency, Washington, D.C.

[21] Appl. No.: 815,969

[22] Filed: Jul. 15, 1977

[30] Foreign Application Priority Data

Jul. 16, 1976 [GB] United Kingdom ..... 29709/76

[51] Int. Cl.[2] ..... F23G 5/02

[52] U.S. Cl. ..... 110/106; 209/467; 209/474; 241/19; 241/79.1; 110/347; 110/220; 110/222

[58] Field of Search ..... 209/11, 1, 499, 474–476, 209/466–469, 20, 132; 241/19, 80, 81, 79.1; 110/220, 347, 222, 106

[56] References Cited

U.S. PATENT DOCUMENTS

| | | | |
|---|---|---|---|
| 1,948,800 | 2/1934 | Revelart | 209/467 |
| 2,200,472 | 5/1940 | Erdmann | 209/475 |
| 2,310,894 | 2/1943 | Brusset | 209/467 |
| 3,078,048 | 2/1963 | Russell et al. | 241/19 |
| 3,349,912 | 10/1967 | Eveson et al. | 209/474 |
| 3,446,355 | 5/1969 | Boucraut et al. | 209/474 |
| 3,513,858 | 5/1970 | Pietrucci | 241/19 |
| 3,595,385 | 7/1971 | Duff | 209/1 |
| 3,951,081 | 4/1976 | Martin et al. | 110/106 |

*Primary Examiner*—Henry C. Yuen

[57] ABSTRACT

Solid particles comprising combustible matter (e.g. coal) associated with or contaminated by inert matter (e.g. ash, rock) is segregated in a segregation zone into low density/small size and high density/large size fractions. The low density/small size fractions are passed to a utilization zone for conversion of the combustible matter. The high density/large size fractions are size reduced (e.g. by grinding) and either returned to the segregation zone, or passed at least in part, directly to the utilization zone. The conversion of the combustion matter proceeds more efficiently as a result. The segregation zone may operate by fluidized size/density segregation and in the utilization zone, the combustible matter may be at least partially combusted, preferably in a fluidized bed.

7 Claims, 3 Drawing Figures

UTILIZATION OF SOLID MATERIAL CONTAINING COMBUSTIBLE MATTER

The present invention relates to the utilization of combustible matter which is associated with or contaminated with non-combustible or other inert matter, particularly when the combined combustible and non-combustible or inert matter are available or recovered as solids. Such combined combustible matter comprises, inter alia, coal, shale, lignite brown coal, peat and tar of the type found in tar sands.

Taking coal as typical example of the foregoing, the non-combustible or inert material—i.e. predominantly ash, may form up to 80% of the amount of coal produced by mining or like operations. If the coal is to be utilized by partial or complete combustion, it is convenient to reduce the coal to a fine particle size for injection into a suitable furnace or gasifier. Such a furnace or gasifier may be of the fluidized bed type. The part-combustion of the small-size coal in furnaces and gasifiers, particularly but not exclusively, of the fluidized type, leads to elutriation not only of ash but also of a considerable proportion of unburned or partly-burned coal which may, at least in part, be discarded or lost with the ash.

If the coal or other combustible matter is to be utilized as a chemical feedstock, or for the preparation of a chemical feedstock, the separation of inert material may also result in a loss of coal or other potential chemical feedstock material.

In one aspect the present invention provides a method of utilizing combustible matter associated with or contaminated by non-combustible or inert material, comprising the steps of:

(a) supplying substantially solid particles, including relatively coarse, substantially solid particles, of the combustible matter and associated contaminants into a segregation zone;

(b) segregating particles in the segregation zone according to at least one property including a characteristic selected from size and density;

(c) recovering particles of relatively small sizes and/or relatively low densities from the segregation zone and passing the recovered particles to a utilization zone;

(d) separately recovering particles of relatively large size and/or relatively high density from the segregation zone and reducing the sizes of said separately recovered particles; and (e) passing size-reduced particles of relatively small size and/or relatively density, obtained from step (d), to the utilization zone.

In another aspect, the present invention provides apparatus for use in the utilization of combustible matter associated with, or contaminated by, non-combustible or inert material, comprising:

(a) a segregation zone adapted for receiving substantially solid particles, including relatively coarse substantially solid particles of combustible matter and associated contaminants and operable for segregating particles according to at least one property comprising a characteristic selected from size and density;

(b) means adapted to be connected to a particles-utilization zone and operable for passing particles of relatively small size and/or relatively low density from the segregation zone to the utilization zone;

(c) size-reduction means connected for receiving particles of relatively large size and/or relatively high density from the segregation zone and for reducing the size of said particles; and (d) means operable for passing size-reduced particles directly or indirectly to the said particles utilization zone.

The segregation of particles in the segregation zone may be effected by one or more techniques selected from flotation, mechanical size—and mechanical density-separation techniques.

Preferably, the segregation in the segregation zone is effected "dry"—i.e. without employing liquids in the zone to promote or aid segregation The segregation zone may comprise mechanical size and/or density segregation equipment of any suitable type, including, for example, jigs, spirals (e.g. Humphrey spirals), cyclones, tables, chutes, but wet methods employing segregation equipment such as the foregoing, and/or launders may also be used.

Preferably, the segregation is effected by fluidizing the particles in the segregation zone employing an upwardly-passing fluidizing fluid so that a density and/or size gradient is established therein with the higher density and/or larger particles towards the bottom of the zone and the lower density and/or smaller particles towards the top. A gradient of increasing density and/or size of particles in the segregation zone is established by providing that the superficial velocity of the fluidizing fluid in the zone is sufficient to fluidize the particles but below the velocity at which the fluid causes substantially uniform mixing of the particles. The latter velocity is usually characterized by the presence of "bubbles" of the fluidizing fluid. The lower sized or lower density particles are recovered from the upper end of the zone and passed to the utilization zone wherein the combustible matter is utilized, e.g., is at least partly burned or dissolved or solvent-extracted. The larger sized and higher density particles are recovered from the lower end of the segregation zone and size-reduced by e.g. crushing and/or grinding. Preferably, size-reduced particles are returned or circulated back to the segregation zone for further segregation by size and/or density.

If the utilization zone is adapted for at least partial combustion of the coal, it is preferably of the fluidized bed gasification or combustion type, and non-combustible matter is readily elutriated from the fluidized bed while combustible matter is relatively efficiently consumed.

Preferably, particles of relatively small size and/or density are fluidized in a distribution zone, which may constitute part of, or communicate with, the segregation zone (preferably a top region thereof), employing an upwardly-passing fluidizing fluid whereby particles pass into at least one conduit connected for introducing said particles to said utilization zone. The fluidizing fluid, together with any solids elutriated and/or entrained from the particles in the distribution zone, may be employed to inject the particles into the utilization zone via the said conduit. In this way, pollution of the environment with solids-containing fluid is substantially avoided, and the energy of the fluid is employed usefully.

The fluidized segregation of particles in the segregation zone is advantageous in that the fluidized bed established in the zone may serve to convey the finer and/or less dense particles to an array of particle injection points in an extended (i.e. wide) fluidized combustor or gasifier.

The rate of operation of the size-reduction step is preferably governed by the relative amounts of particles of large size and/or high density to particles of small size and/or low density. When the relative amounts increase, an increased amount of particles of large size and/or high density is withdrawn from the segregation zone for size reduction, and when the relative amounts decrease, a reduced amount of large size and/or high density particles is withdrawn.

In a further aspect, the invention provides a plant for the chemical and/or physical conversion, and/or resolution, of combustible matter associated with, or contaminated by, non-combustible or inert material, comprising apparatus as hereinabove described in combination with a utilization zone connected for receiving substantially solid particles of said contaminated combustible matter of relatively small size and/or low density from the segregation zone, the utilization zone being operable for the chemical and/or physical conversion and/or resolution of at least part of the combustible matter.

Some non-limitative examples of the invention are now described with reference to the accompanying drawings, in which.

Figure 1:
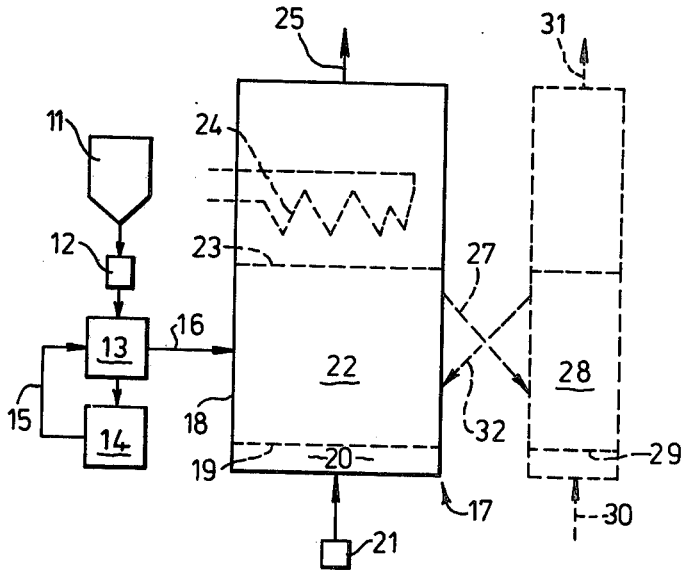
FIG. 1 is a schematic diagrammatic flow sheet of an embodiment of the invention.

Reference is first made to FIG. 1 which shows the principal features of a plant indicated generally by reference 10 for the utilization of combustible material (e.g. carbonaceous and/or hydrocarbonaceous material) which is contaminated by or associated with non-combustible or inert matter.

The contaminated material (in particulate form) is received and temporarily stored in a silo or hopper 11 and removed therefrom at a controlled rate by a feeding device 12 such as a star valve or other solids feeding equipment. The feeding device 12 delivers the contaminated particulate material to a segregation zone 13 wherein the particles are segregated into portions of relatively small size and/or relatively low density and relatively large size and/or relatively high density. The segregation zone 13 may segregate the portions mechanically, by flotation, centrifugally, pneumatically or by any combination of two or more of the foregoing techniques.

Particles of relatively large size and/or relatively high density are recovered from the segregation zone 13 and passed to a size-reduction zone 14 wherein the particles are crushed and/or ground.

The crushed and/or ground particles are returned to the segregation zone 13 via conduit 15 for further segregation.

Particles of relatively small size and/or low density are passed from the segregation zone 13 via conduit 16 to a utilization zone, generally indicated by reference 17. The utilization zone comprises a vessel 18 in which the combustible matter in the particles is utilized for purposes such as the generation of heat (e.g. by combustion or part-combustion), the generation of synthesis or reducing gases (e.g. by part-oxidation optionally in the presence of steam) or for the production of chemical feedstocks (e.g. by pyrolysis, solvent extraction, treatment with hot liquids, treatment with hydrogen or hydrogen-donating substances) inter alia.

Because the particles supplied to the utilization zone are of relatively small size and/or relatively low density, the utilization of the combustible matter from the particles will be, on the whole, substantially uniform and the conditions within the utilization zone can be arranged to ensure relatively optimum utilization of the combustible matter.

In a particular instance, given for non-limitative illustrative purposes, the utilization zone 17 may at least partially burn the particles containing combustible matter. Thus, the vessel 18 may contain a distributor plate 19 defining with the bottom of the vessel a space 20 into which is passed a combustion-supporting gas (e.g. air) from a pump, fan or other source 21. The distributor plate 19 supports a bed 22 of fluidized particles and the combustible matter is at least partially burned in the bed 22. Hot gases and elutriated fines leave the top surface 23 of the bed 22 and heat may be recovered by suitable heat recovery means 24 above the surface 23 (as shown) and/or immersed in the bed 22 (not shown). The (part)-combustion conditions within the bed 22, including the superficial velocity of gas therethrough, are correlated with the particle size and/or density so as to ensure that the (part)-combustion is as complete as possible and the amount of unconsumed carbonaceous and/or hydrocarboneous material in the fines elutriated from the bed 22 is as small as possible, so that the fines consist of substantially non-combustible and/or inert solids. The gases and entrained fines pass out of vessel 18 via line 25.

The bed 22 may contain substances for forming solid compounds of potential environmental pollutants. For example, bed 22 may contain calcium oxide for reacting with sulfur in the feed particles to form solid compounds of calcium and sulfur (e.g. CaS under net reducing conditions and $CaSO_4$ under net oxidizing conditions). In order to maintain the sulfur-fixing activity of the bed 22 without discarding reacted CaO and replacing the latter with fresh CaO, bed material is preferably passed via conduit 27 to a regenerator bed 28 supported on a distributor 29 near the bottom of a distributor vessel 30 containing the bed. The bed 28 is subjected to suitable conditions for regenerating CaO with the liberation of sulfur moieties (e.g. $SO_2$). Preferably, if the bed 28 contains CaS, it is fluidized by an upwardly-passing stream of oxygen containing gas (e.g. air) supplied from line 30, and if the bed contains $CaSO_4$, a reducing agent is injected directly into the bed 28 from a separate conduit (not shown). Gases containing liberated sulfur moieties leave the vessel via line 31 and particles containing regenerated CaO are returned from a top region of bed 28 to a lower region of bed 22 via a conduit 32 for further use in fixing sulfur. Processes for producing substantially sulfur-free gases from sulfur-containing fuels by methods of the foregoing type are described in U.K. patent specifications Nos. 1183937; 1336563 and 1408888, inter alia.

Figure 2:
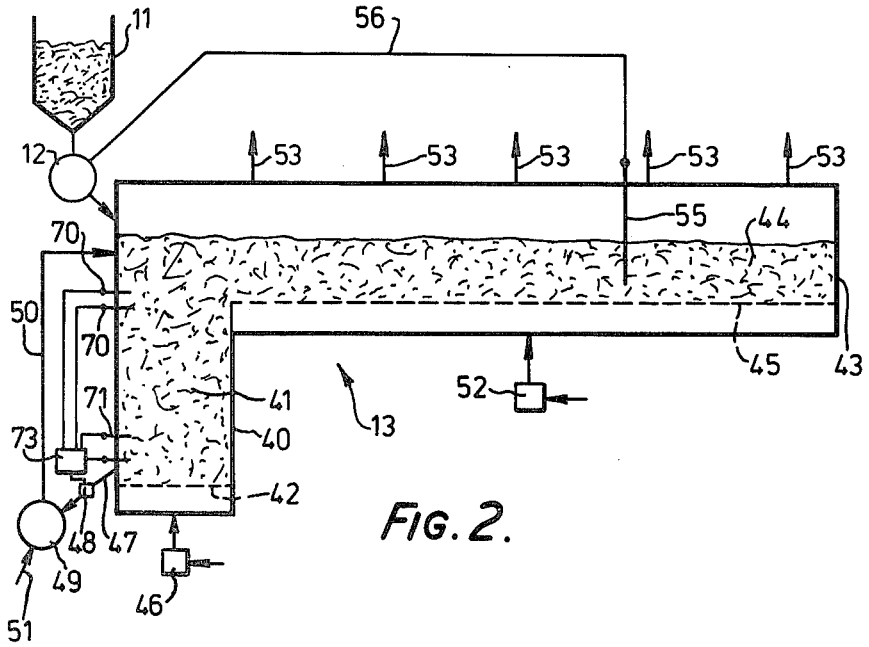
FIG. 2 is a schematic diagrammatic size-elevation of a vertical cross-section of part of an apparatus according to the invention.

Reference is now made to FIG. 2 which shows examples of some of the equipment which are preferably employed in the plant of FIG. 1. For illustrative purposes, it is assumed that the contaminated combustible material is coal containing or associated with ash.

Particles of the coal are received in the silo or hopper 11 and supplied at a desired rate by the feeding device 12 (a lock-hopper or rotary valve—e.g., a star valve) into the segregation zone, indicated generally by reference 13. The segregation zone is deepest at one end 40

(the left-hand end, as shown) where the coal forms a relatively deep bed 41 supported above a fluid distributor 42. In the shallower part 43 of the zone 13, the coal forms a relatively shallow bed 44 supported above a fluid distributor 45.

A fluidizing gas, e.g. air, is passed from a source 46 (e.g. a fan) into the deep bed 41 via distributor 42 at a controlled rate such that the coal particles are fluidized in the bed 41 but no so fluidized (e.g. by the action of gas bubbles, which have a greater tendency to form as the superficial gas velocity is increased) that vertical mixing of the particles to produce a substantially uniformly-mixed bed takes place. In the range of fluidizing gas velocities below velocities at which uniform mixing of particles is promoted, particles of the larger sizes and/or higher densities sink downwardly in the bed 41 and particles of smaller sizes and/or lower densities rise in the bed 41. Thus, a gradient of increasing particle size and/or density is established between the top and bottom of bed 41, and particles having sizes and/or densities suitable for use in the utilization zone may be removed from the upper regions of the bed 41. Particles of larger sizes and/or higher densities are withdrawn from the bottom region of the bed 41 via line 47 at a rate regulated by a controller 48 and passed to a grinder 49 wherein the particles are ground to sizes including sizes in the range of the particle sizes at the upper regions of the bed 41. The ground particles are passed via conduit 50 to an upper region of the segregation zone 13, either into the top regions of the bed 41 or into the shallow bed 44. The passage of the ground particles up conduit 50 may be aided by or under the action of a transporting fluid (preferably a gas such as air) blown into the conduit 50 from, e.g., a pipe 51 connected to the grinder 49.

The rate of withdrawal of particles from the bottom region of the bed 41 is arranged to be dependant upon the difference in densities between the upper and lower regions of the bed 41. In the upper regions of the bed are provided a number of density probes or tappings 70, and near the bottom region are provided a number of density probes or tappings 71. The probes or tappings 70, 71 may be of any type—e.g. they may measure the local pressure within the bed. Signals representative of the densities in the upper and bottom regions of the bed 41 are suitably generated in any known manner and transmitted to a regulator 73. When the difference in densities between the upper and bottom regions of the bed 41, as perceived by the regulator 73, tends to increase, a signal for increasing the rate of withdrawal of particles via line 47 is transmitted to the controller 48. When there is a convergence of bed densities, as perceived by the regulator 73, the rate of withdrawal of particles via line 47 as governed by controller 48, is reduced. Accordingly, the overall action of the segregation zone and associated equipment is to provide particles having sizes and/or densities within a selected range at the upper regions of the bed 41.

The relatively small and/or relatively low density particles pass to and fill the shallow bed 44, which serves as a distribution zone, wherein they are fluidized by an upwardly passing gas (e.g., air) supplied from a fan or other source 52. The fluidized particles pass into ports (not shown in FIG. 2) below the top surface of the bed 44 and are thence distributed into the utilization zone. The gas leaving the top surface of the bed 44 elutriates fines and may be vented to atmosphere via conduits 53, possibly after a de-dusting operation. However, it is greatly preferred to employ the dusty gas to inject the particles into the utilization zone since this makes better use of the fluid energy, and also avoids the necessity of de-dusting the gas.

The rate of supply of coal from the silo 11 into the segregation zone 13 is preferably regulated by determining the amount of coal in the bed 44 and supplying additional coal when there is less than a desired amount. Thus, one or more coal depth probes 55 may determine the pressure within the bed 44, and by means of suitable transducers (not shown) may generate signals representative of the depth of coal in the bed 44. Such depth signals are relayed, via a line 56, to the feeding device 12 so that when the bed depth falls below a selected level, the device 12 feeds coal particles from silo 11 to the segregation zone 13.

Figure 3:
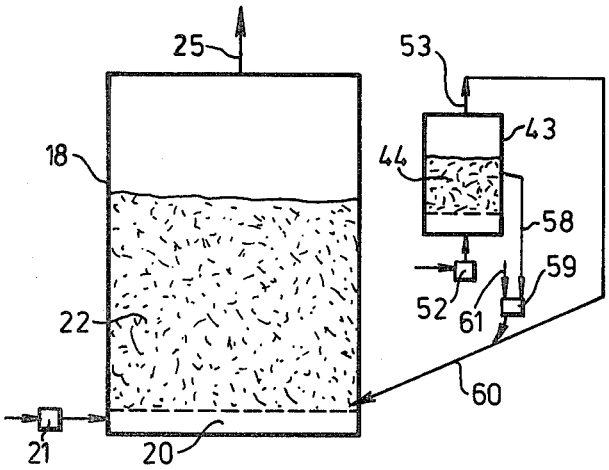
FIG. 3 is a schematic diagrammatic end elevation of a vertical cross-section of an apparatus according to the invention, incorporating the part shown in FIG. 2.

Reference is now made to FIG. 3 from which it will be seen that coal particles pass out of the bed 44 into downcomers 58 having coal meters 59 at their bottom ends. The coal meters operate to pass particles into respective injection tubes 60 in accordance with a coal demand signal from the plant, which signal is generated in a known manner. The coal meters may be of the screw-feed type or endless belt or vibratory-feed type. As depicted, the respective meter 59 is of the type in which accumulated coal in a part (not shown) of the meter is blown by a pulse of gas (e.g. air) from tube 61 into the injection tube 60. A meter of this type is described in U.K. patent specification No. 1336563.

The particles, when in the injection tubes 60, are transported into the bed 22 of the utilization zone by the dusty fluidizing gas from conduits 53. An eductor (not shown) of e.g. known type, may be provided at the location where the particles are to enter each injection tube whereby the eduction of particles from the respective coal meter outlet by the energy of the dusty fluidizing gas may be effected relatively efficiently.

It will be appreciated that all or some of the coal from the grinder 49 may be fed directly to the utilization zone—e.g., directly to the bed 22.

It will further be appreciated that the length of the shallow part 43 of the zone 13 corresponds (approximately) with the length of the vessel 18 which is to be supplied with coal particles. Thus, the shallow part 43 serves as a coal distributor for a vessel 18 which is relatively extensive—i.e. wide, and enables the vessel to be supplied relatively uniformly, over its width, with coal particles of a substantially constant quality. For vessels 18 which are not wide or extensive, the provision of a discrete shallow bed 44 may not be necessary.

The items of equipment herein described may be employed in other combinations that those specifically illustrated without departing from the scope of the invention as defined in the following claims.

What I claim is:

1. A method for utilizing a solid particulate feedstock containing combustible matter contaminated with non-combustible or inert material comprising the steps;

a. passing the feedstock into a fluidized bed segregation zone having a fluidizing gas passing upwardly therethrough whereby relatively fine particles and relatively light particles migrate upwardly and relatively dense particles and relatively coarse particles migrate downwardly through the fluidized bed, b. removing the relatively dense and the relatively coarse particles from the lower portion of the fluidized bed segregation zone, c. passing said dense and coarse particles through a comminuter zone to reduce them to a finer size, d. returning the reduced particles to the fluidized bed segregation zone, e. adjusting the rate of removal of the relatively dense and the relatively coarse particles from the fluidized bed segregation zone to maintain a predetermined particle size and density gradient in said zone, f. adjusting the rate of introduction of the feedstock to the fluidized bed segregation to maintain the upper level of the fluidized bed at a predetermined height, g. removing dust-laden gas from the upper portion of the fluidized bed segregation zone, above the surface of the fluidized bed, h. continuously withdrawing the finer particles and the lighter particles from the upper portion of the said segregation zone and passing them into a fluidized bed utilization zone.

2. The method of claim 1 wherein the finer and the lighter particles are passed into the utilization zone employing the dust-laden gas as a conveyor gas.

3. The method of claim 2 wherein the dust-laden gas is removed from the upper portion of the fluidized bed segregation zone at a plurality of points and passed into the utilization zone with the finer and the lighter particles at a like plurality of points.

4. The method of claim 1 wherein the utilization zone is a combustion zone.

5. Apparatus for segregating combustible matter from a solid particulate feedstock containing combustible matter contaminated with non-combustible or inert material and for utilizing the segregated combustible matter comprising;

a. a fluidized bed segregation zone having an upper and lower region adapted to receive a continuous feed of said feedstock, b. means for removing relatively dense particles and relatively coarse particles from the lower region of said zone, c. comminution means for comminuting the particles removed from said lower region to a relatively fine size, d. means for conveying said comminuted particles to the upper portion of the fluidized segregation zone, e. means for adjusting the rate of withdrawal of the relatively coarse particles and relatively dense particles from the lower region of said zone to maintain a predetermined finer particle size in said zone, f. means for adjusting the rate of introduction of the feedstock to the fluidized segregation zone to maintain the upper level of the fluidized bed at a predetermined height, g. means for removing dust-laden gas from the upper portion of the segregation zone, above the surface of the fluidized bed, and h. means for continuously withdrawing finer particles from the upper portion of the said segregation zone and passing them into a fluidized bed utilization zone.

6. The apparatus of claim 5 comprising means employing the dust-laden gas for passing the finer particles into the utilization zone.

7. The apparatus of claim 5 wherein the upper region of the fluidized bed segregation zone is elongated horizontally and the fluidized bed utilization zone is disposed generally parallel to the said upper region, a plurality of means for removing the dust-laden gas from the upper portion of the fluidized bed segregation zone, and a like plurality of means for passing the dust laden gas and finer particles into said utilization zone.

* * * * *